US007351105B2

(12) United States Patent
Delaney et al.

(10) Patent No.: US 7,351,105 B2
(45) Date of Patent: Apr. 1, 2008

(54) BOARD MOUNTED SHIELDED ELECTRICAL CONNECTOR

(75) Inventors: Kevin Delaney, Ennis Clare (IE); Maurice Shanahan, Limerick (IE); Kieran Wright, Co. Clare (IE); Padraig McDaid, Limerick (IE); Patrick Tunn, Galway (IE); Sean McGreevy, Limerick (IE); Eugene Folan, Galway (IE); Pat White, Ennis Co. Clare (IE)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/270,849

(22) Filed: Nov. 9, 2005

(65) Prior Publication Data

US 2007/0105440 A1 May 10, 2007

(51) Int. Cl.
*H01R 13/648* (2006.01)

(52) U.S. Cl. ..... 439/607

(58) Field of Classification Search ..... 439/607, 439/101, 108.83, 609, 79
See application file for complete search history.

(56) References Cited

U.S. PATENT DOCUMENTS 5,378,172 A 1/1995 Roberts
5,496,195 A 3/1996 Reed
5,591,050 A * 1/1997 Sueoka ..... 439/607
5,637,014 A * 6/1997 Sukegawa et al. ..... 439/607
5,928,035 A * 7/1999 Jankowsky et al. ..... 439/607
6,007,379 A 12/1999 Michaelis et al.
6,086,429 A * 7/2000 Wu ..... 439/676
6,109,967 A * 8/2000 Chiou ..... 439/607
6,290,540 B1 * 9/2001 Nishio et al. ..... 439/607
6,386,918 B1 5/2002 Zheng et al.
6,435,912 B1 * 8/2002 Zhu et al. ..... 439/607
6,447,311 B1 * 9/2002 Hu et al. ..... 439/108
6,682,368 B2 1/2004 Murr et al.
6,796,839 B1 * 9/2004 Wu ..... 439/607
6,884,116 B2 * 4/2005 Suzuki et al. ..... 439/607

OTHER PUBLICATIONS

Molex Product No. 76503-0020 appearing in the web page "http://www.molex.com/cgi-bin/bv/molex/index.jsp?destination=product.html" after entering the product No. 67503-0020. This product was ifrst available in the United States on Feb. 22, 2002.

* cited by examiner

*Primary Examiner*—Alexander Gilman
(74) *Attorney, Agent, or Firm*—Charles S. Cohen

(57) ABSTRACT

A shielded electrical connector is provided for mounting on a printed circuit board. The connector includes a dielectric housing mounting a plurality of conductive terminals having tail portions for connection to appropriate circuit traces on the printed circuit board. A shielding shell is mounted over the dielectric housing and includes a top wall, opposite side walls and a rear wall. A bottom portion of the rear wall closest to the printed circuit board is connected to a ground pad on the circuit board by a surface connection.

16 Claims, 7 Drawing Sheets

BOARD MOUNTED SHIELDED ELECTRICAL CONNECTOR

FIELD OF THE INVENTION

This invention generally relates to the art of electrical connectors and, particularly, to a shielded electrical connector for mounting on a printed circuit board.

BACKGROUND OF THE INVENTION

Many electrical connectors are designed for mounting on a printed circuit board. Such board mounted connectors typically include some form of dielectric housing mounting a plurality of terminals which have contact portions for engaging the terminals of a complementary mating connector. The terminals typically have tail portions for connection, as by soldering, to appropriate circuit traces on the printed circuit board. The tail portions might be inserted into holes in the printed circuit board for solder connection to circuit traces on the board and/or in the holes, or the tail portions may be surface connected to the flat circuit traces on the board. Surface connections, such as by wave soldering techniques, are very efficient and cost effective, while inserting the terminal tail portions into holes in the board may involve complications and more costly assembly processes.

Some board mounted electrical connectors are shielded connectors to protect the electrical connections from EMI and/or RF interference or "noise". The shielding often is provided by a metal shielding shell which substantially surrounds the dielectric housing of the connector. One of the problems with shielded connectors is that the dielectric housing often is inserted or assembled into the shielding shell from an opening which typically is at the rear of the connector. If this insertion or assembly opening is not closed by the shell, EMI and/or RF leakage occurs through the opening. Therefore, the shielding shell may be provided with a rear wall which closes the opening. Heretofore, such a rear wall had tail portions insertable into holes in the printed circuit board. Although this reduced EMI to some degree, the amount of EMI reduction has not been sufficient. Unexpectedly, it has been found that the EMI can be reduced almost as much as soldering the entire bottom portion of the rear wall to the printed circuit board by electrically connecting only a bottom portion or edge of the rear wall closest to the circuit board to a ground pad on the board by a surface connection. This shortens the electrical distance between the bottom of the rear wall and the printed circuit board and, thereby, further reduces EMI and/or RF interference.

SUMMARY OF THE INVENTION

An object, therefore, of the invention is to provide a new and improved shielded electrical connector for mounting on a printed circuit board.

In the exemplary embodiments of the invention, the shielded electrical connector includes a dielectric housing mounting a plurality of conductive terminals having tail portions for connection to appropriate circuit traces on the printed circuit board. A shielding shell is mounted over the dielectric housing and includes a top wall, opposite side walls and a rear wall. A bottom portion of the rear wall closest to the printed circuit board is connected to a ground pad on the circuit board by a surface connection.

Preferably, the bottom portion of the rear wall of the shell comprises a bottom edge of the rear wall. In some embodiments of the invention, the bottom edge of the rear wall is surface connected directly to the ground pad on the circuit board. In one embodiment, the bottom edge of the rear wall extends transversely along substantially the width of the dielectric housing. In another embodiment, the rear wall includes a pair of side legs spaced transversely to define a space therebetween which allows for visualization of the connections between the tail portions of the terminals and the circuit traces on the circuit board. The side legs have bottom edges which are surface connected directly to ground pad means on the circuit board.

In other embodiments of the invention, the bottom portion of the rear wall of the shell is indirectly connected to the ground pad means on the circuit board by a surface connection. Specifically, the shielding shell includes a bottom tab which is surface connected directly to the ground pad on the circuit board. The bottom portion of the rear wall, in turn, is mechanically connected to the bottom tab. In one embodiment, the bottom portion of the rear wall comprises a bottom edge of the rear wall in direct engagement with the bottom tab. In another embodiment, the bottom tab has an upturned lip mechanically interengaged in a notch in a bottom edge of the rear wall of the shell. In a further embodiment, the bottom tab is located at one side of the shell and includes an upturned lip mechanically engaged with a side edge of the rear wall of the shell. In still another embodiment of the invention, the bottom tab includes an opening which receives a post extending from the rear wall of the shell, with the post mechanically engaged in the opening.

As disclosed herein, the top wall of the shielding shell includes a pair of securing tabs to hold the shell on the housing. The securing tabs are located at opposite rear corners of the top wall of the shell. The rear wall has a "whale tail" configuration with a narrow portion between the securing tabs and a wider portion spanning the rear of the shell. The bottom portion of the rear wall which is connected to the ground pad on the circuit board runs along a bottom edge of the wider portion of the rear wall.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 4:
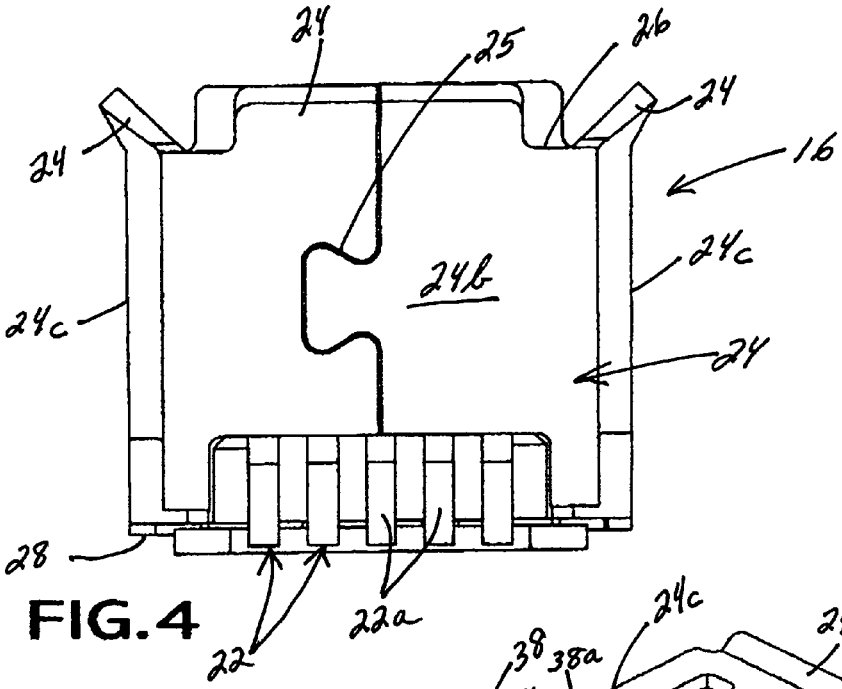
FIG. 4 is a bottom plan view of the connector in FIG. 1.
Figure 5:
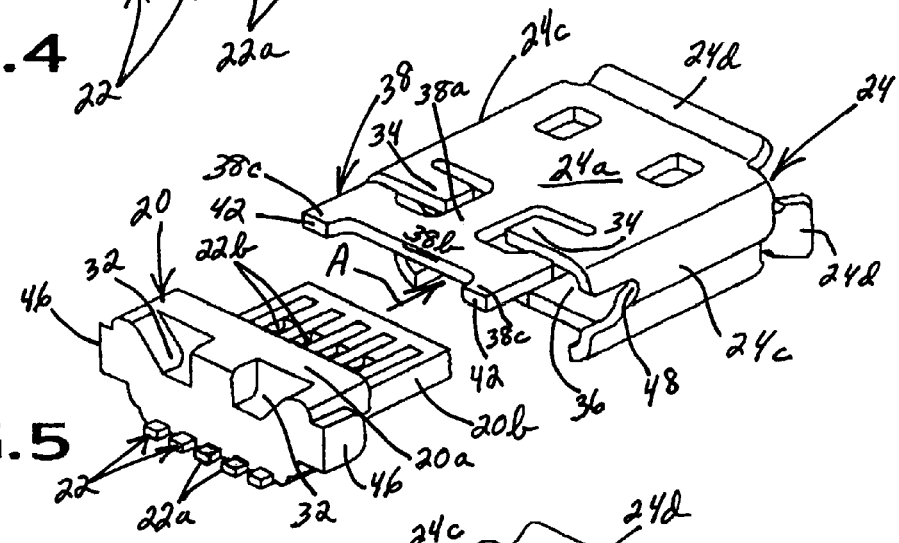
FIGS. 5 and 6 are sequential views showing steps in the assembly of the connector of FIG. 1.

Referring to the drawings in greater detail, and first to FIGS. 1-4, a first embodiment of the invention is shown in a shielded electrical connector, generally designated 16, which is mounted on a printed circuit board 18. The connector basically includes a dielectric housing, generally designated 20, mounting a plurality of conductive terminals, generally designated 22, with the housing substantially surrounded by a shielding shell, generally designated 24. As best seen in FIG. 5, the housing may be a one-piece structure unitarily molded of dielectric material, such as plastic or the like. Shielding shell 24 may be stamped and formed of conductive sheet metal material, with joining edges of the sheet metal interengaged at a dove tail joint 25 shown in FIGS. 3 and 4. In place of conductive sheet metal, plated plastic can be used. Terminals 22 have tail portions 22*a* for surface connection, as by wave soldering, to appropriate traces on printed circuit board 18.

Figure 1:
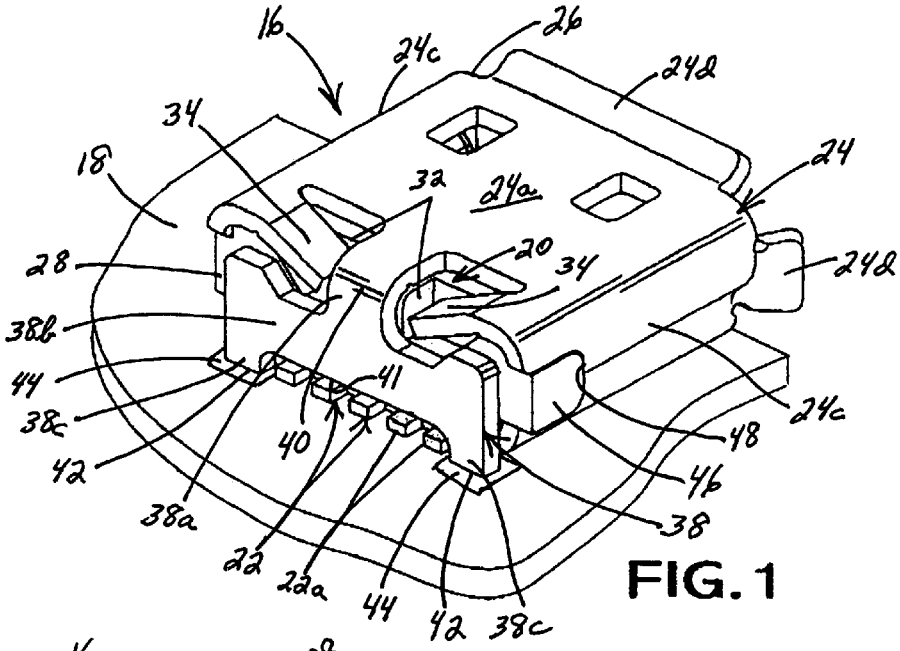
FIG. 1 is a rear perspective view of a shielded, board mounted electrical connector according to a first embodiment of the invention.
Figure 2:
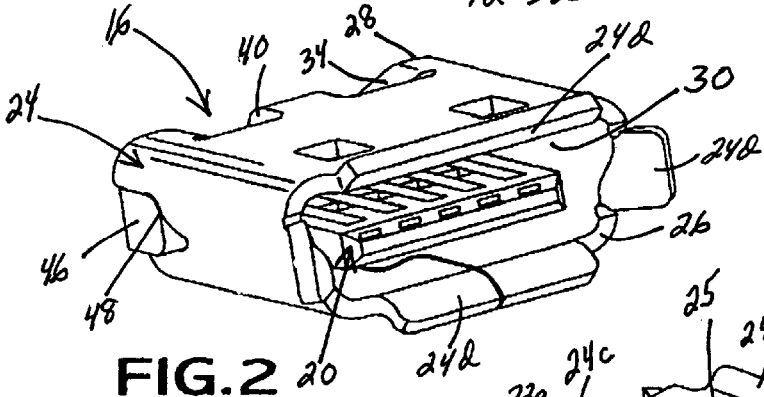
FIG. 2 is a view similar to that of FIG. 1, looking at the front mating end of the connector.
Figure 3:
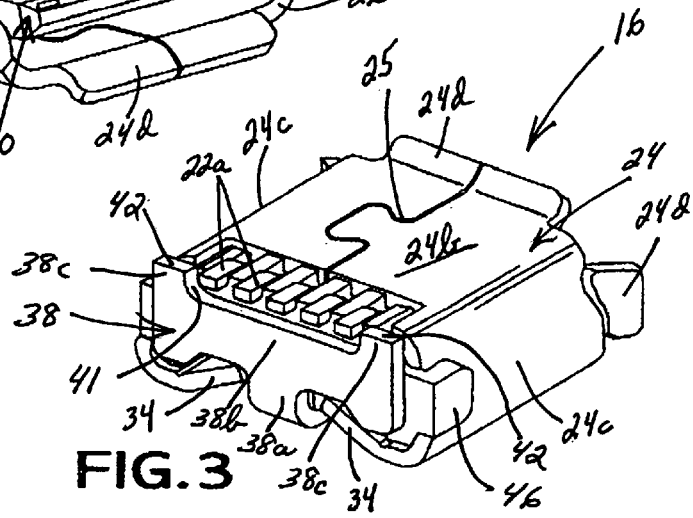
FIG. 3 is a bottom perspective view of the connector of FIG. 1.

Dielectric housing 20 and metal shell 24 combine to define a front mating end 26 and a rear terminating end 28 of connector 16. As best seen in FIG. 2, metal shell 24 defines a receptacle 30 at mating end 26 for receiving a complementary mating connector. As best seen in FIGS. 1 and 4, tail portions 22*a* of terminals 22 are located at rear terminating end 28 of the connector.

Referring to FIG. 5 in conjunction with FIGS. 1-4, dielectric housing 20 of connector 16 includes a body portion 20*a* and a forwardly projecting mating portion 20*b*. Tail portions 22*a* of terminals 22 are located at the bottom of body portion 20*a*. Mating portion 20*b* of the housing mounts contact portions 22*b* of the terminals for engaging appropriate terminals of the mating connector. As seen in FIG. 5, a pair of securing recesses 32 are formed in the top rear edge of body portion 20*a* of the housing, for purposes described hereinafter. As seen in FIG. 2, mating portion 20*b* of the housing projects into receptacle 30 formed by metal shell 24, with the mating portion spaced from the interior walls of the receptacle.

Metal shielding shell 24 of connector 16 includes a top wall 24*a* (FIGS. 1 and 2), a bottom wall 24*b* (FIGS. 3 and 4) and a pair of side walls 24*c* joining the top and bottom walls. Outwardly flared lips 24*d* at the front of the shell help guide the mating connector into receptacle 30. A pair of securing tabs 34 are bent downwardly at the rear corners of top wall 24*a*, into securing recesses 32 of housing 20, to hold the housing in the shell, as will be seen hereinafter.

As best seen in FIG. 5, metal shielding shell 24 has a rear opening 36 into which body 20 is assembled. Once assembled, the rear opening is closed by a rear wall, generally designated 38, of metal shell 24. The rear wall is bent downwardly, as at 40, from top wall 24*a* of the shell. The rear wall has a "whale tail" configuration which defines an narrow portion 38*a* between securing tabs 34 and a wider portion 38*b* which spans and substantially closes rear opening 36. In the first embodiment of FIGS. 1-6, rear wall 38 includes a pair of side legs 38*c* which define a space 41 (FIG. 1) therebetween which allows for visual inspection of the connections between tail portions 22*a* of terminals 20 and the circuit traces on circuit board 18. The invention contemplates that a bottom portion of rear wall 38: (namely, bottom edges 42 of side legs 38*c*), be connected to a ground pad 44 on printed circuit board 18. In the first embodiment of FIGS. 1-6, bottom edges 42 are directly connected, as by soldering, to the ground pad means on the circuit board.

Figure 6:
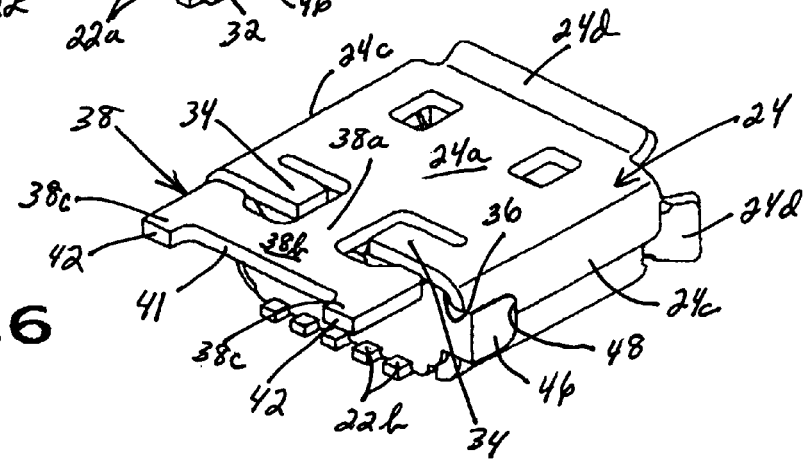

FIGS. 5 and 6 show how the subassembly of dielectric housing 20 and terminals 22 are assembled into metal shell 24 in the direction of arrow "A" (FIG. 5). Once the subassembly is fully inserted into the metal shell, a pair of abutment bosses 46 at opposite sides of body 20 abut within a pair of notches 48 in side walls 24*c* of the metal shell. This stops insertion of the body and defines the forward limit position thereof within the metal shell. After the body is fully inserted, securing tabs 34 of the metal shell are bent downwardly into securing recesses 32 in the body as seen in FIG. 1. This prevents the body from backing out of the shell. After the subassembly of the body and the terminals is fully inserted as shown in FIG. 6, rear wall 38 then is bent downwardly to close rear opening 36, to the position shown in FIG. 1 where bottom edges 42 of side legs 38*c* of the rear wall can be connected, as by soldering, directly to ground pad means 44 on circuit board 18.

Figure 7:
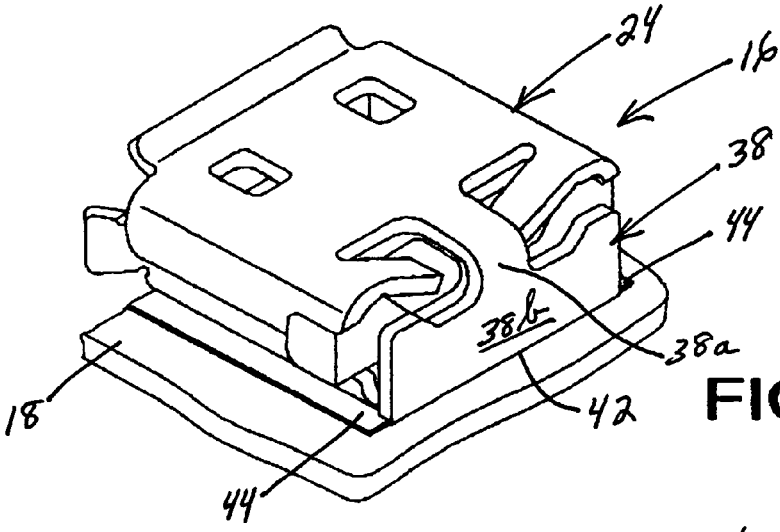
FIG. 7 is a top, rear perspective view of a second embodiment of the invention.
Figure 8:
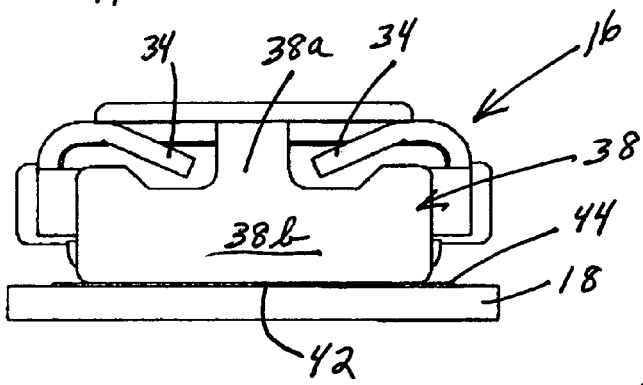
FIG. 8 is a rear elevational view of the second embodiment.

FIGS. 7 and 8 show a second embodiment of the invention. At this point, it should be understood that like reference numerals have been applied in FIGS. 7, 8 and 10A-14B for like components shown in FIGS. 1-6 and described above. In addition, the descriptions of those like components will not be repeated to avoid overburdening the specification.

With the second embodiment of FIGS. 7 and 8, it can be seen that rear wall 38 of metal shell 24 has a continuous side-to-side bottom edge 42 which extends transversely along the entire width of the rear wall, i.e., substantially the width of the dielectric housing of the connector. This entire bottom portion or edge 42 of the rear wall is connected directly, as by soldering, to the ground pad means 44 on printed circuit board 18. Otherwise, the connector is substantially identical to connector 16 described above in relation to FIGS. 1-6.

Figure 9:
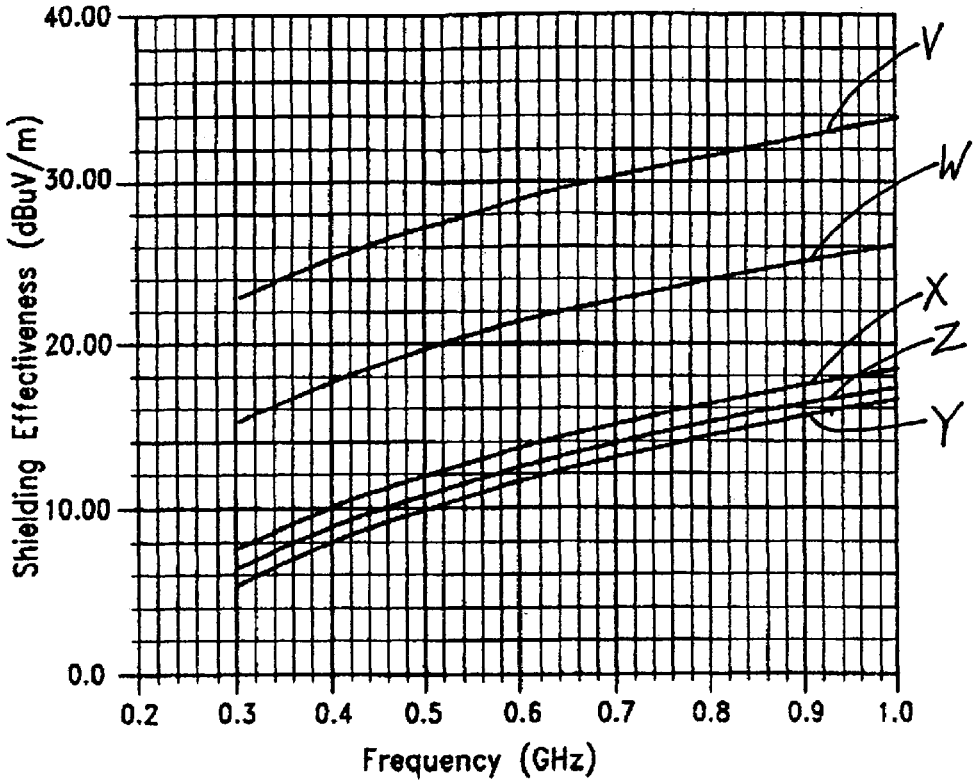
FIG. 9 is a graph showing the shielding effectiveness of the embodiments of the invention.

FIG. 9 shows a graph which charts the shielding effectiveness of the various embodiments of the invention. The vertical coordinates of the graph represent the shielding effectiveness (dBuv/m). The horizontal coordinates of the graph represent the frequency (Ghz) of the terminal signals. Line "V" on the graph represents the effectiveness if the rear opening (36) of such a connector is left open. Line "W" on the graph indicates the effectiveness of a connector having a rear wall which closes the opening, but the rear wall is not connected to the printed circuit board. Line "X" on the graph represents the effectiveness of the first embodiment of the invention shown in FIGS. 1-6. Line "Y" on the graph shows the effectiveness of the second embodiment of the invention as shown in FIGS. 7 and 8. This graph represents the results of electrical simulations and, as can be seen, the electrically grounded rear walls are extremely effective. In fact, the extent of the effectiveness was quite unexpected.

Figure 10A:
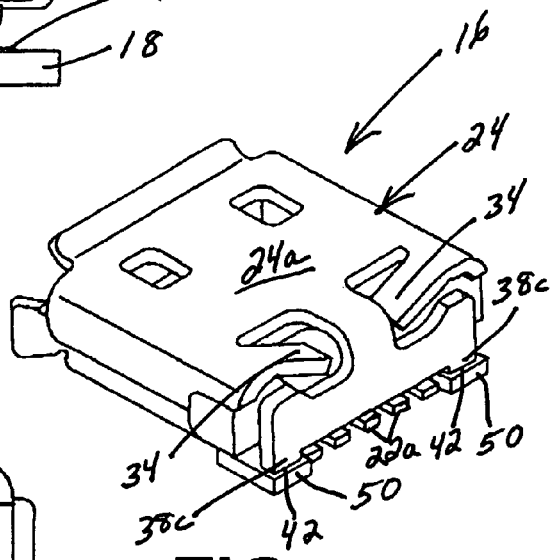
FIG. 10A is a top, rear perspective view of an electrical connector according to a third embodiment of the invention.
Figure 10B:
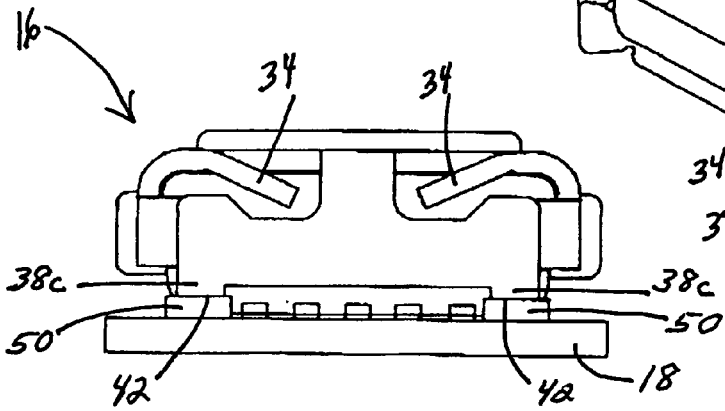
FIG. 10B is a rear elevational view of the third embodiment.
Figure 10C:
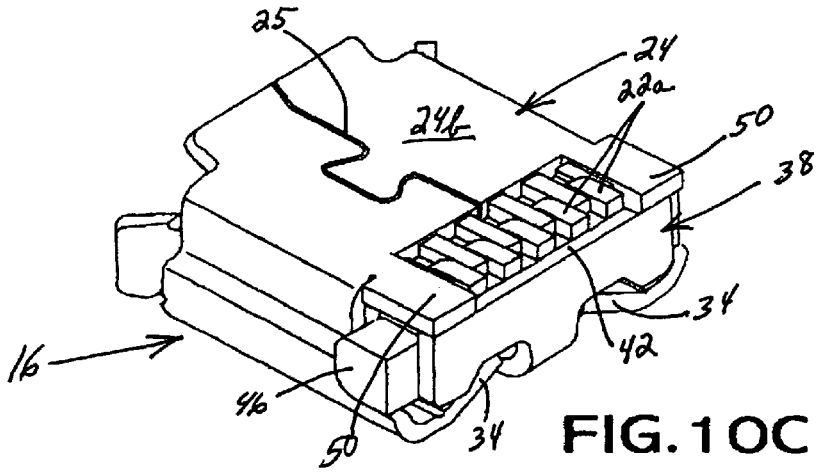
FIG. 10C is a bottom, rear perspective view of the third embodiment.

FIGS. 10A-10C show a third embodiment of the invention. In this embodiment, a pair of bottom tabs 50 project rearwardly at opposite sides of bottom wall 24*a* of metal shell 24. The bottom tabs are coplanar with the bottom wall of the shell. As seen in FIGS. 10A and 10B, rear wall 38 of the shell has a pair of side legs 38*c* which have bottom edges 42 in engagement with the top surfaces of bottom tabs 50. In FIG. 10C, rear wall 38 has a continuous side-to-side bottom edge 42, but the ends of this continuous edge are in engagement with the top surfaces of bottom tabs 50. In either event, the bottom edge(s) of the side wall directly engages the bottom tabs which, in turn, are directly connected, as by soldering, to the ground pad means on circuit board 18. Bottom edges 42 can be engaged with the bottom tabs by a mechanical interference joint and/or by a welding process.

Figure 11A:
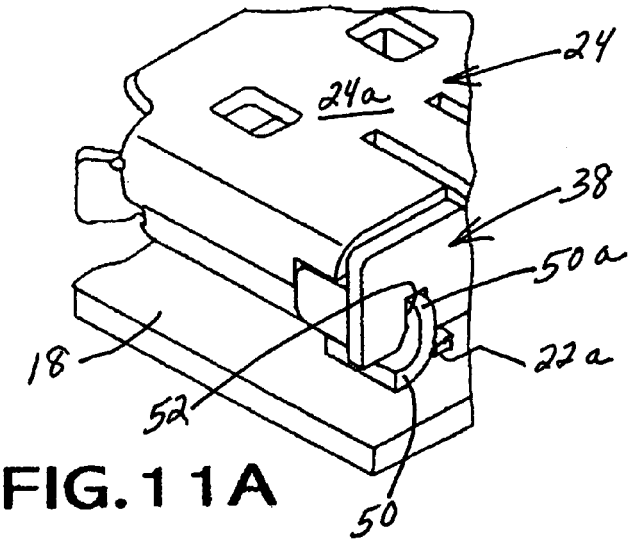
FIG. 11A is a fragmented perspective view of a rear corner of an electrical connector according to a fourth embodiment of the invention.
Figure 11B:
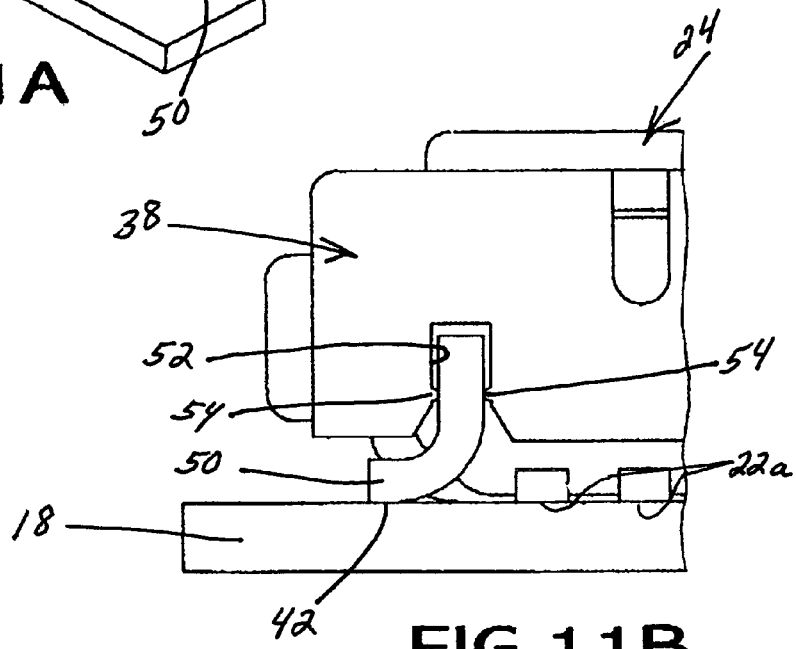
FIG. 11B is a fragmented rear elevational view of the fourth embodiment.

FIGS. 11A and 11B show a fourth embodiment of the invention, wherein, like the third embodiment, a pair of bottom tabs 50 project rearwardly of the bottom wall of the metal shell. However, in the fourth embodiment of FIGS. 11A and 11B, the bottom tabs have upturned lips 50*a* which are mechanically interengaged in a pair of notches 52 at opposite sides of rear wall 38 of the metal shell. The opposite sides of the notches are provided with pressure bosses 54 which increase the mechanical interengagement between upturned lips 50*a* and the rear wall of the shell. Again, bottom tabs 50 are connected directly, as by soldering, to the ground pad means on the circuit board.

Figure 12:
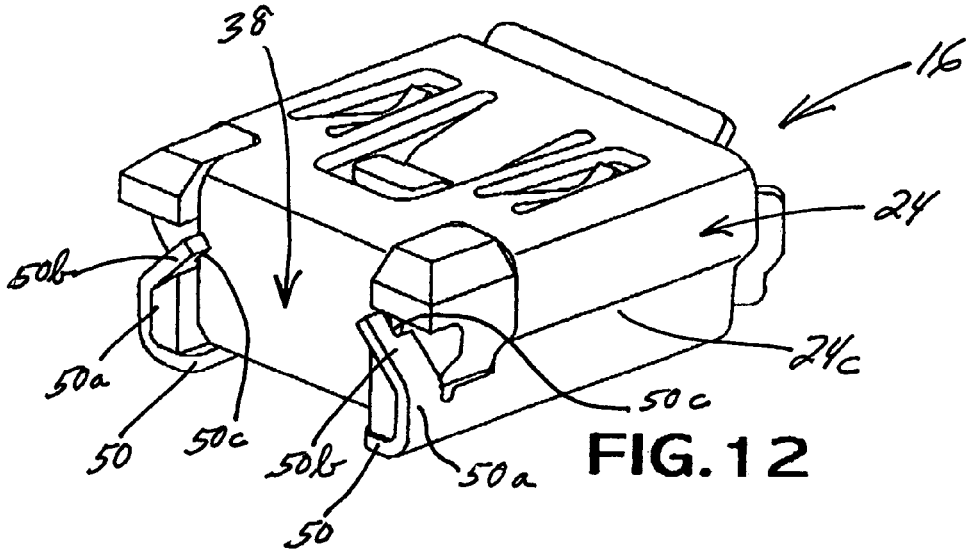
FIG. 12 is a top, rear perspective view of an electrical connector according to a fifth embodiment of the invention.

FIG. 12 shows a fifth embodiment of the invention. In this embodiment, side walls 24*c* of the metal shell are extended rearwardly whereby bottom tabs 50 are bent inwardly from the side walls at opposite sides of the shell. The bottom tabs have upturned lips 50*a* which have inwardly turned distal ends 50*b*. The distal ends are notched, as at 50*c*, for engaging the side edges of rear wall 38 to establish a positive mechanical interference therewith. Again, bottom tabs 50 are connected, as by soldering, to the ground pad means on the circuit board.

Figure 13B:
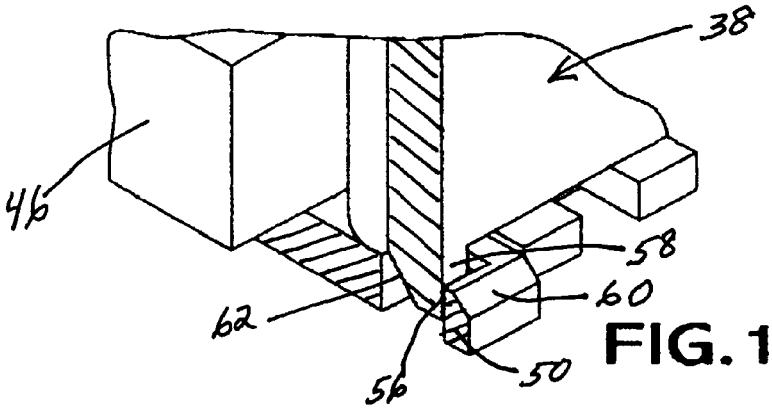
FIG. 13B is a fragmented, partially sectioned perspective view of the bottom left-hand corner of the connector shown in FIG. 13A.
Figure 13A:
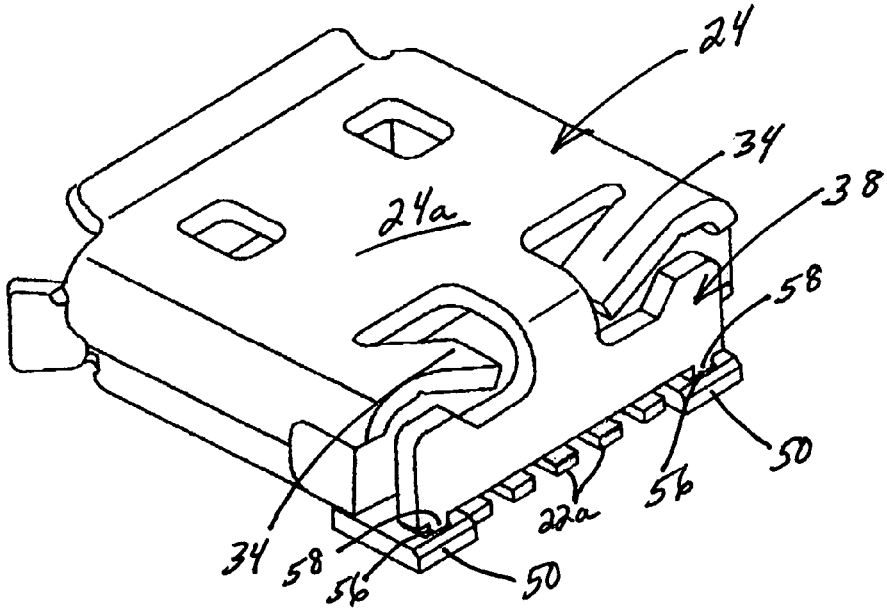
FIG. 13A is a top, rear perspective view of an electrical connector according to a sixth embodiment of the invention.

FIGS. 13A and 13B show a sixth embodiment of the invention wherein bottom tabs 50 are provided with openings 56 for receiving a pair of posts 58 which depend from rear wall 38 of the metal shell. As best seen in FIG. 13B, the top rear edges of tabs 50 are chamfered, as at 60, and the bottom front distal ends of posts 58 are chamfered, as at 62. Therefore, when rear wall 38 is bent downwardly during assembly to close the rear of the connector, these chamfered surfaces spread the components so that the posts will "snap" into the openings. The posts may be press-fit into the openings or the resiliency of the rear wall can create a positive mechanical interference between the posts and the bottom tabs which are connected, as by soldering, directly to the ground pad means on the circuit board.

Figure 14A:
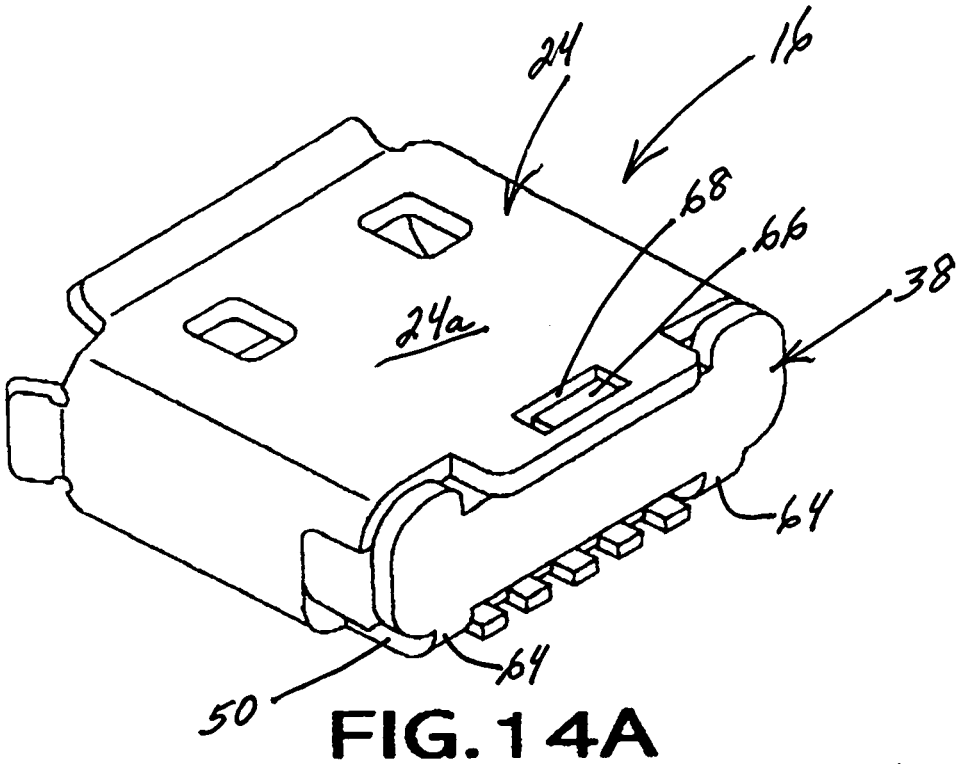
FIG. 14A is a top, rear perspective view of an electrical connector according to a seventh embodiment of the invention.
Figure 14B:
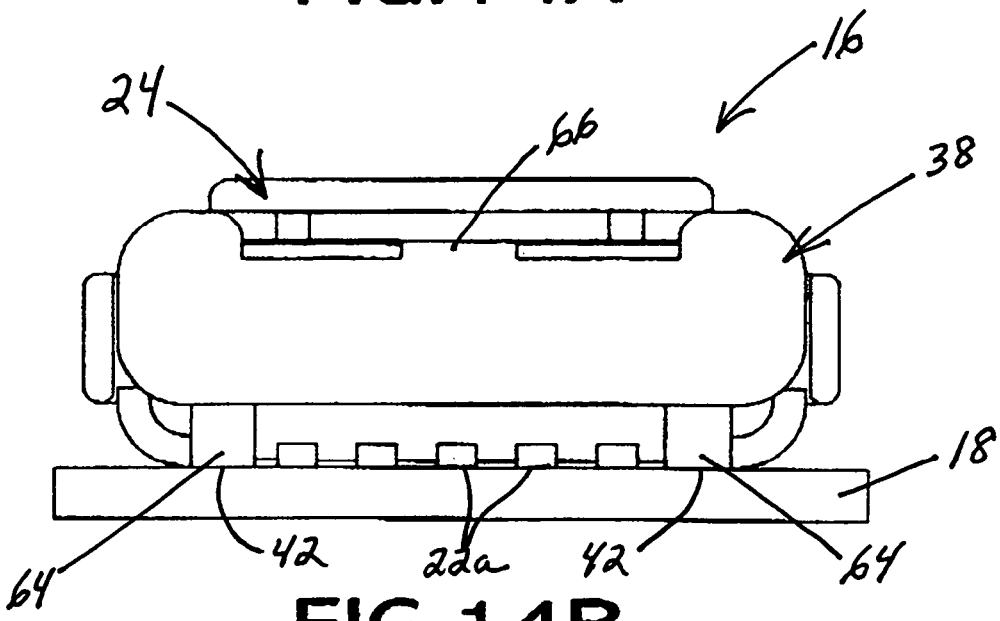
FIG. 14B is a rear elevational view of the connector in FIG. 14A.

FIGS. 14A and 14B show a seventh embodiment of the invention wherein rear wall 38 is connected integrally with bottom tabs 50 and is bent upwardly, as at 64, to close the rear opening of the metal shell. The top edge of the rear wall is provided with a center post 66 which is positioned to extend within an opening 68 in top wall 24*a* of the metal shell. To help hold the rear wall in its upwardly bent position. With bottom tabs 50 connected directly, as by soldering, to the ground pad means on the printed circuit board, rear wall 38 is coupled directly to the ground pad means.

Referring back to the graph of FIG. 9, line "X" represents the effectiveness of the second through sixth embodiments of the invention as shown in FIGS. 10A-13B. Line "Z" represents the effectiveness of the seventh embodiment of the invention as shown in FIGS. 14A and 14B.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A shielded electrical connector for mounting on a printed circuit board, comprising:

a dielectric housing mounting a plurality of conductive terminals having tail portions for connection to appropriate circuit traces on the printed circuit board;

a shielding shell mounted over the dielectric housing and including a top wall, opposite side walls and a rear wall, a bottom portion of the rear wall closest to the printed circuit board being configured to be connected to a grounding pad on the circuit board by a surface connection;

wherein said bottom portion of the rear wall of the shell comprises a bottom edge of the rear wall;

wherein said bottom edge of the rear wall is configured to be surface connected directly to the ground pad on the circuit board; and wherein said rear wall includes a pair of side legs spaced transversely to define a space therebetween which allows for visualization of the connections between the tail portions of the terminals and the circuit traces on the circuit board, the side legs having bottom edge portions surface configured to be connected directly to ground pad means on the circuit board.

2. The shielded electrical connector of claim 1 wherein said bottom edge of the rear wall extends transversely along substantially the width of the dielectric housing.

3. The shielded electrical connector of claim 1 wherein said shielding shell includes a bottom tab which is configured to be surface connected directly to the ground pad on the circuit board, and the bottom portion of the rear wall of the shell, in turn, is configured to be mechanically connected to the bottom tab.

4. A shielded electrical connector for mounting on a printed circuit board, comprising:

a dielectric housing mounting a plurality of conductive terminals having tail portions for connection to appropriate circuit traces on the printed circuit board;

a shielding shell mounted over the dielectric housing and including a top wall, opposite side walls and a rear wall, a bottom portion of the rear wall closest to the printed circuit board being configured to be connected to a grounding pad on the circuit board by a surface connection;

wherein said shielding shell includes a bottom tab which is configured to be surface connected directly to the ground pad on the circuit board, and the bottom portion of the rear wall of the shell, in turn, is configured to be mechanically connected to the bottom tab; and wherein said bottom tab has an upturned lip mechanically interengaged in a notch in a bottom edge of the rear wall of the shell.

5. The shielded electrical connector of claim 4 wherein said shielding shell has a bottom wall, and said bottom tab projects rearwardly of the bottom wall.

6. The shielded electrical connector of claim 4, including a pair of said bottom tabs having upturned lips on opposite sides of the rear wall of the shell, and wherein said rear wall includes a pair of side legs spaced transversely to define a space therebetween which allows for visualization of the connections between the tail portions of the terminals and the circuit traces on the circuit board, the side legs having bottom edge portions having notches for receiving the upturned lips of said bottom tabs.

7. The shielded electrical connector of claim 4 wherein said bottom tab is located at one side of the shell and includes an upturned lip mechanically engaged with a side edge of the rear wall of the shell.

8. The shielded electrical connector of claim 4 wherein said bottom portion of the rear wall comprises a bottom edge of the rear wall in engagement with said bottom tab.

9. The shielded electrical connector of claim 8, including a pair of said bottom tabs at opposite sides of the shell, and the rear wall includes a pair of side legs spaced transversely to define a space therebetween which allows for visualization of the connections between the tail portions of the terminals and the circuit traces on the circuit board, the side legs having bottom edge portions in engagement with the pair of bottom tabs.

10. A shielded electrical connector for mounting on a printed circuit board, comprising:

a dielectric housing mounting a plurality of conductive terminals having tail portions for connection to appropriate circuit traces on the printed circuit board;

a shielding shell monnted over the dielectric housing and including a top wall, opposite side walls and a rear wall, a bottom portion of the rear wall closest to the printed circuit board being configured to be connected to a grounding pad on the circuit board by a surface connection;

wherein said shielding shell includes a bottom tab which is configured to be surface connected directly to the ground pad on the circuit board, and the bottom portion of the rear wall of the shell, in turn, is configured to be mechanically connected to the bottom tab; and wherein said bottom tab includes an opening which receives a post depending from the rear wall of the shell, with the post mechanically engaged in the opening.

11. The shielded electrical connector of claim 10, including a pair of said bottom tabs having openings at opposite sides of the shell, the rear wall having a pair of said depending posts at opposite sides thereof mechanically engaged in the openings in the bottom tabs.

12. A shielded electrical connector for mounting on a printed circuit board, comprising:

a dielectric housing mounting a plurality of conductive terminals having tail portions for connection to appropriate circuit traces on the printed circuit board;

a shielding shell mounted over the dielectric housing and including a top wall, opposite side walls and a rear wall, a bottom portion of the rear wall closest to the printed circuit board being configured to be connected to a grounding pad on the circuit board by a surface connection; and wherein the top wall of said shielding shell includes a pair of securing tabs to hold the shell on the housing, the securing tabs being located at opposite rear corners of the top wall, and the rear wall of the shell has a "whale tail" configuration with a narrow portion between the securing tabs and a wider portion spanning the rear of the shelf.

13. A shielded electrical connector for mounting on a printed circuit board, comprising:

a dielectric housing mounting a plurality of conductive terminals having tail portions for connection to appropriate circuit traces on the printed circuit board;

a shielding shell mounted over the dielectric housing and including a top wall, opposite side walls and a rear wall, a bottom portion of the rear wall closest to the printed circuit board being configured to be connected to a grounding pad on the circuit board by a surface connection;

wherein said shell includes a bottom wall, and said rear wall is bent upwardly from the bottom wall at the bottom portion of the rear wall, with the bottom wall being configured to be connected directly to the ground pad on the circuit board by a surface connection near the bottom portion of the rear wall; and wherein a top edge of the rear wall has a center post which is positioned to extend within opening in the top wall of the metal shell to help hold the rear wall in its upwardly bent position.

14. A shielded electrical connector for mounting on a printed circuit board, comprising:

a dielectric housing mounting a plurality of conductive terminals having tail portions for connection to appropriate circuit traces on the printed circuit board; and a shielding shell mounted over the dielectric housing and including a top wall, opposite side walls and a rear wall, the top wall including a pair of securing tabs located at opposite rear corners thereof to hold the shell on the housing, the rear wall having a "whale tail" configuration with a narrow portion between the securing tabs and a wide portion spanning the rear of the shell, a bottom edge of the wider portion of the rear wall being configured to be surface connected directly to a ground pad on the circuit board.

15. The shielded electrical connector of claim 14 wherein said bottom edge of the wider portion of the rear wall extends transversely along substantially the width of the dielectric housing.

16. The shielded electrical connector of claim 14 wherein The wider portion of said rear wall includes a pair of side legs spaced transversely to define a space therebetween which allows for visualization of the connections between the tail portions of the terminals and the circuit traces on the circuit board, the side legs having bottom edge portions configured to be surface connected directly to ground pad means on the circuit board.

* * * * *